US008839529B1

(12) United States Patent
Levy

(10) Patent No.: US 8,839,529 B1
(45) Date of Patent: Sep. 23, 2014

(54) SANDALS WITH RE-CONFIGURABLE STRAPS

(71) Applicant: Avi Levy, Fresh Meadows, NY (US)

(72) Inventor: Avi Levy, Fresh Meadows, NY (US)

(73) Assignee: Snapir Wear LLC, New York, NY (US)

( * ) Notice: Subject to any disclaimer, the term of this patent is extended or adjusted under 35 U.S.C. 154(b) by 0 days.

(21) Appl. No.: 14/278,709

(22) Filed: May 15, 2014

(51) Int. Cl.
*A43B 3/12* (2006.01)

(52) U.S. Cl.
CPC ..... *A43B 3/122* (2013.01)
USPC ..... 36/11.5; 36/100; 36/50.1; 24/442

(58) Field of Classification Search
USPC ..... 36/11.5, 50.1, 15, 100, 101; 24/442
See application file for complete search history.

(56) References Cited

U.S. PATENT DOCUMENTS

| | | | | | |
|---|---|---|---|---|---|
| 2,526,940 | A * | 10/1950 | Fello | 36/11.5 |
| 2,590,648 | A * | 3/1952 | Pitz | 36/11.5 |
| 3,455,037 | A * | 7/1969 | Vlas et al. | 36/11.5 |
| 4,297,798 | A | 11/1981 | Colan | |
| 4,815,172 | A * | 3/1989 | Ward | 24/16 R |
| 5,423,134 | A * | 6/1995 | Bagnaia et al. | 36/11.5 |
| RE35,452 | E * | 2/1997 | Sargeant | 36/11.5 |
| 5,794,360 | A * | 8/1998 | Bell et al. | 36/7.6 |
| 5,836,090 | A * | 11/1998 | Smith | 36/7.6 |
| 6,543,157 | B2 * | 4/2003 | Pan | 36/11.5 |
| 6,606,803 | B1 * | 8/2003 | Ritter et al. | 36/11.5 |
| 7,188,396 | B2 * | 3/2007 | Melbye et al. | 24/452 |
| 7,272,897 | B2 | 9/2007 | Yu | |
| 8,413,349 | B2 * | 4/2013 | Krauss | 36/94 |
| 8,661,715 | B2 * | 3/2014 | Roth | 36/101 |
| 2002/0124433 | A1 * | 9/2002 | Pan | 36/11.5 |
| 2004/0025372 | A1 * | 2/2004 | Watanabe | 36/8.1 |
| 2005/0252036 | A1 * | 11/2005 | Laska | 36/11.5 |
| 2006/0026861 | A1 * | 2/2006 | Manzi | 36/11.5 |
| 2007/0124958 | A1 * | 6/2007 | Massey | 36/11.5 |
| 2008/0000107 | A1 | 1/2008 | Styles | |
| 2010/0223812 | A1 * | 9/2010 | Batanero Bastida | 36/100 |

* cited by examiner

*Primary Examiner* — Marie Bays
(74) *Attorney, Agent, or Firm* — James P. Demers; Demers & Berks LLP

(57) ABSTRACT

The invention provides sandals having straps that can be reconfigured by the user into a variety of styles and arrangements, so as to obtain a desired appearance, fit, and/or degree of comfort. The straps can also be configured to hold the sandals to the calves, thighs, or arms, so that the sandals can be carried in a hands-free manner. In certain embodiments, the sandals have a sufficiently low density and a high enough volume to provide a useful amount of buoyancy when the wearer is floating or swimming.

16 Claims, 10 Drawing Sheets

SANDALS WITH RE-CONFIGURABLE STRAPS

FIELD OF THE INVENTION

This invention relates to the field of footwear, and more particularly to the field of sandals intended as beachwear.

BACKGROUND

The wearing of ordinary footwear on sandy beaches is avoided by most regular beach visitors, because of the discomfort and inconvenience of sand getting into one's shoes. Going barefoot is common, but under certain circumstances this too is uncomfortable, for example if the sand is very hot, or if it harbors hard or sharp objects such as rocks, fragments of coral, or broken shells. Washed-up fragments of seaweed or jellyfish present additional hazards. A simple and popular solution to the problem is the wearing of sandals.

Sandals are widely available in a wide variety of styles and designs, from simple, flat "flip-flops" to anatomically-shaped footbeds with elaborate arrangements of straps and fasteners. In order to have a selection of styles at hand, however, one must purchase several pairs of sandals. The present invention provides sandals with straps that can be readily re-configured by the user into a variety of styles, whether in the interest of appearances or for comfort.

What all prior art designs also have in common is that when they are removed while walking, for example if the wearer wishes to walk barefoot in or near the water, they must then be carried along. It would be desirable to have sandals that can be removed at will, that still leave the wearer's hands free. The sandals of the present invention provide this desirable feature as well.

BRIEF DESCRIPTION OF THE INVENTION

The present invention provides sandals having a reconfigurable strap system that permits the sandals to be worn with any of several arrangements of the straps, according to the needs or whims of the wearer. The reconfigurable strap system also permits the sandals to be removed from the feet and strapped to the wearer's calves, thighs, or arms. The wearer is thus free to walk barefoot, without the encumbrance of two now-useless objects that have to be carried in the hands until they are placed back on the feet.

In particular embodiments of the invention, the sole of the sandals incorporates cork, a light-weight polymer foam, or equivalent material, having a density and total volume sufficient to provide an effective amount of buoyancy to the wearer. When strapped to the arms or legs, and in particular to the thighs or biceps, the sandals of the invention, in these embodiments, become the equivalent of "water wings", and can serve as a safety device and as an aid to swimming.

DETAILED DESCRIPTION OF THE INVENTION

The present invention provides sandals having straps configured to hold the sandal to a person's feet, but being reconfigurable so as to permit a wide variety of styles and arrangements of the straps. The straps are also reconfigurable so as to be capable of attaching the sandals to larger-diameter objects, such as the wearer's arms, calves, or thighs. This is accomplished by a strap having a plurality of sequentially arranged sections, which are variously sections of elastic and reversibly adherent fastener surfaces, as described further below.

In broad terms, the invention provides a sandal having at least two straps configured to hold the sandal to a person's foot, each strap having a first side and a second side, and a first end and a second end, and having a plurality of sequentially arranged sections on both sides. At least two of the sections comprise one component of a reversibly adherent fastener system, for example a hook (or loop) surface of a hook-and-loop fastener system, disposed on the second side, and at least one section comprises the complimentary component of the reversibly adherent fastener system, for example a loop (or hook) surface of a hook-and-loop fastener system, also disposed on the second side. Furthermore, at least one section comprises the complimentary component of the reversibly adherent fastener system, for example a loop (or hook) surface of a hook-and-loop fastener system, disposed on the first side. This arrangement enables versatile and variable positioning of the straps, by engagement of the ends of one strap with various sections of the other strap, the straps being held in position by attachment of the reversibly adherent components.

In other embodiments, the first side of the strap will feature four, five, six, or seven sections, or more, wherein each section may independently carry one component of a reversibly adherent fastener system. The second side of the strap will likewise feature four, five, six, or seven sections, or more, wherein each section may independently carry one component of a reversibly adherent fastener system. Preferred embodiments are those where the sections at the ends of the straps carry a component of a reversibly adherent fastener system, on at least one of the two sides, and where the complimentary component of the system is disposed over at least 50%, at least 70%, or at least 80% of the same side, the opposite side, or both sides of the strap.

Figure 2:
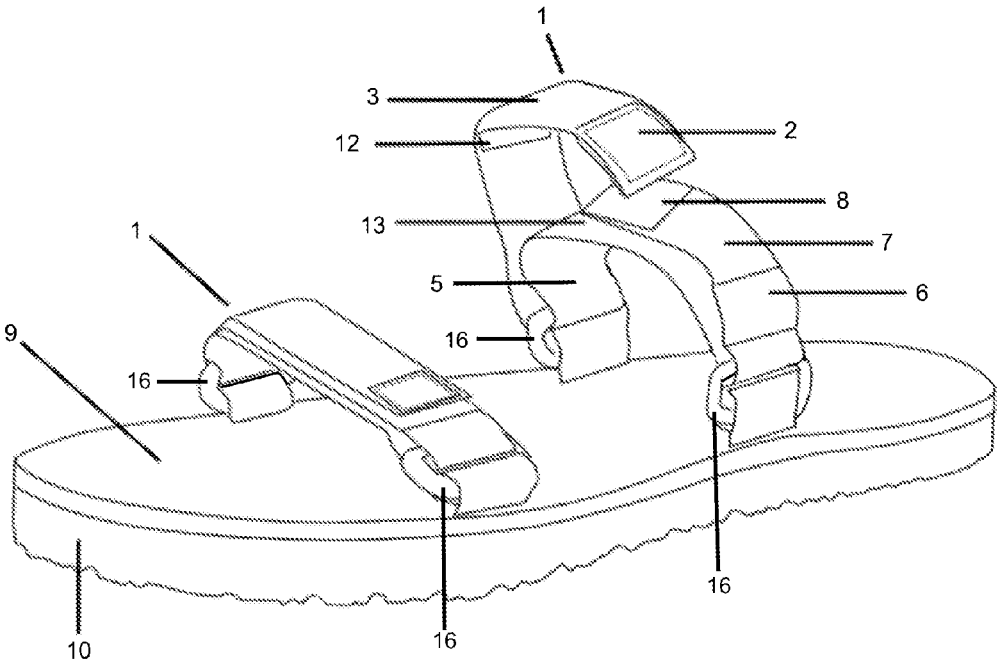
FIG. 2 presents a perspective view of one sandal according to the invention.
Figure 3:
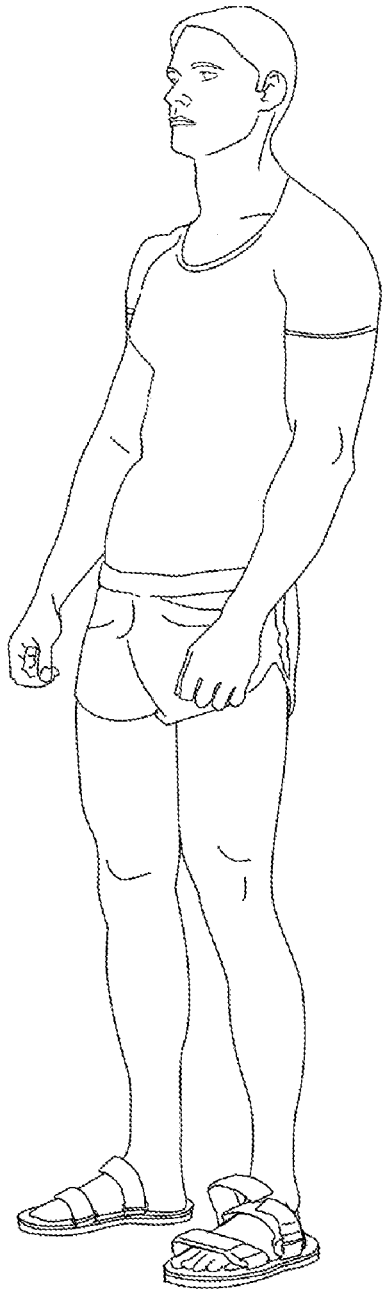
FIG. 3 shows an individual wearing the sandals of the invention on the feet.
Figure 4:
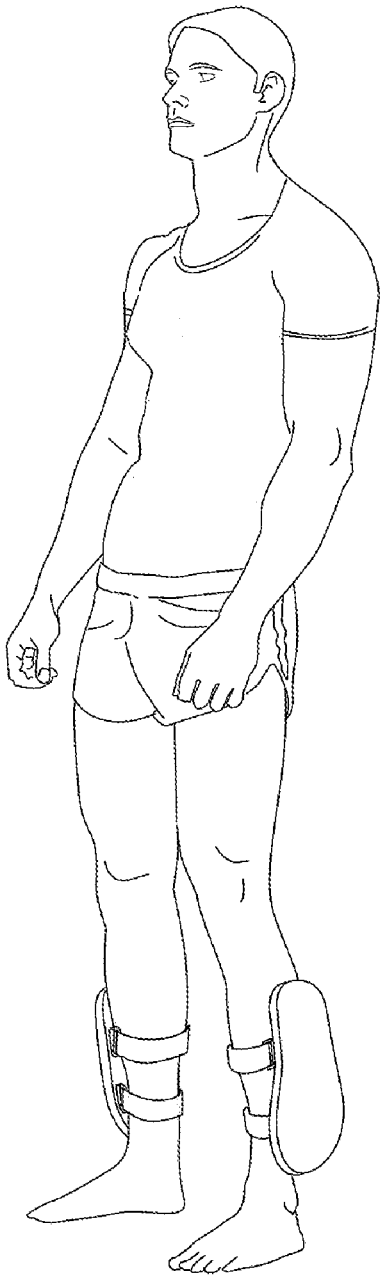
FIG. 4 shows an individual with the sandals of the invention strapped to the calves.
Figure 5:
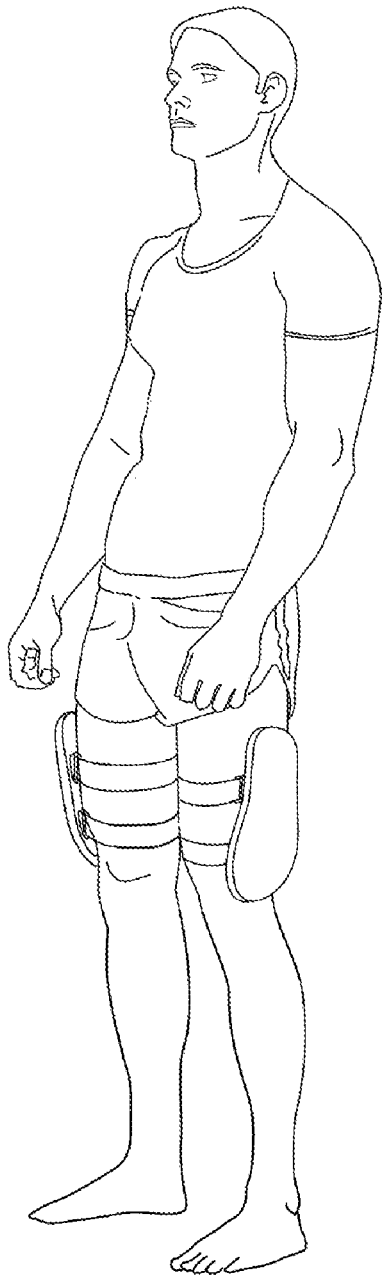
FIG. 5 shows an individual with the sandals of the invention strapped to the thighs.
Figure 6:
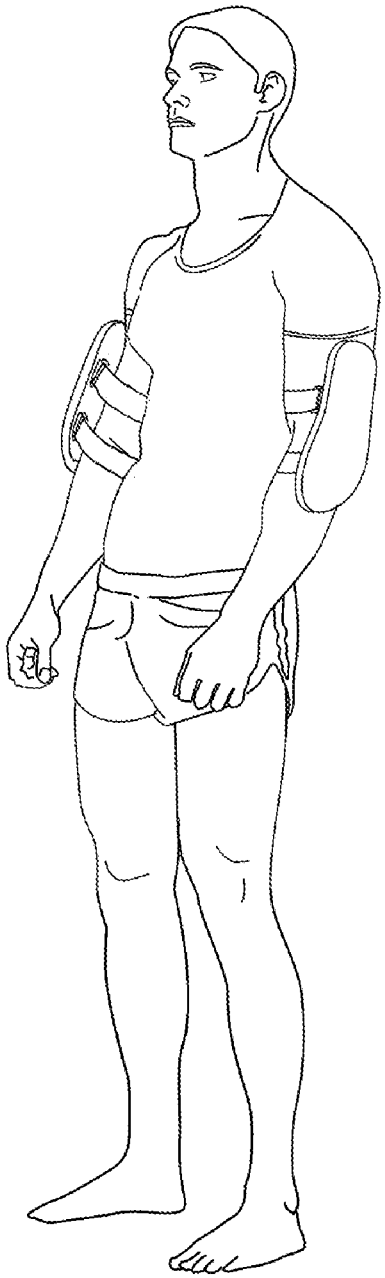
FIG. 6 shows an individual with the sandals of the invention strapped to the arms.

The straps, in a particular embodiment shown in FIG. 2, pass over the wearer's foot, through hoops or loops fastened to the sandal body on either side of the foot, and then back up over the foot, bringing the reversibly adherent fastener surfaces together. When worn over larger-diameter extremities such as the thighs, the configuration is the same, but the reversibly adherent fastener surfaces at the ends of the straps are mated to different locations, sections, or even different sides of the strap.

Preferably, the sandals of the invention feature at least two such straps, one positioned so as to be passable over the forefoot of the wearer (phalanges or metatarsals) and another positioned so as to be passable over the instep (navicular or talus). Additional straps, e.g. to hold the heel in place, may optionally be present. Any end of any strap may be fastened to a complimentary portion of the same strap, or to a complimentary portion of the other strap, at substantially any angle desired. The ends of the rear-most strap may, if desired, be directed around the back of the foot so as to hold down the heel. FIGS. 1A-1L illustrate some of the possible arrangements that a wearer might select.

The reversibly adherent fastener surfaces are surfaces that, when pressed together, adhere to one another with a sufficient degree of retention to keep the sandals attached to the foot during normal wear, yet can be manually separated by the wearer without undue effort when it is desired to remove the sandals. In preferred embodiments, the reversibly adherent fastener surfaces are the mating components of a hook-and-loop fabric fastener system. Reversibly adherent hook-and-loop systems are well known in the art, for example the systems sold under the trade name VELCRO™ by Velcro USA Inc., Manchester N.H. See for example U.S. Pat. No. 3,009,235 and the numerous subsequent patents and applications that cite it, for representative fastener systems. As one alternative to hook-and-loop systems, so-called "mushroom" fasteners, such as the system sold under the trade name DUAL LOCK™ by the 3M Company, St. Paul, Minn., may be employed. Magnetic fasteners are another alternative; see U.S. Pat. No. 4,453,294 and the numerous subsequent patents and applications that cite it, for representative magnetic fastener systems. In general, any of the mutually adherent surface fastener systems that are known in the art of footwear or clothing manufacturing may be employed.

The sandal body comprises at least a sole, and may further comprise a separate footbed and/or an outsole. The footbed, if present, can be textured for grip, shaped for fit, softened for comfort, and/or feature decorative graphics. The outsole, if present, may be textured and/or shaped for traction and gait, and may be constructed of materials that provide improved traction and/or wear resistance. The footbed and outsole may be fastened to the sole by any of the methods known in the art, including but not limited to the use of adhesives, multi-material molding, or thermal bonding.

The sole is preferably made of a resilient, porous material; in general, any material known in the art to be suitable for use as a sandal sole or midsole component may be used in the present invention. Suitable materials include, but are not limited to, EVA foam, polyurethane foam, polyolefin foams, cork, and the like. In certain embodiments of the invention, the sandals are capable of providing buoyancy when the wearer is swimming. In these embodiments, the effective density of the sandal body is preferably lower than 0.6 g/cm$^3$, more preferably lower than 0.4 g/cm$^3$, and most preferably lower than 0.2 g/cm$^3$. The volume of the sandal body, and the buoyancy provided, will be a function of the size of the sandal and the thickness of the sandal body. The volume of a single sandal body will typically range from about 100 to about 600 cm$^3$, with higher volumes providing greater buoyancy. Wearers wishing to take advantage of this feature can do so by selecting thicker soles than they might otherwise choose. "Effective density" of the sandal body refers to the total mass of the entire sandal body, including the sole, footbed, and outsole, divided by the total volume of the sandal body.

Figure 7A:
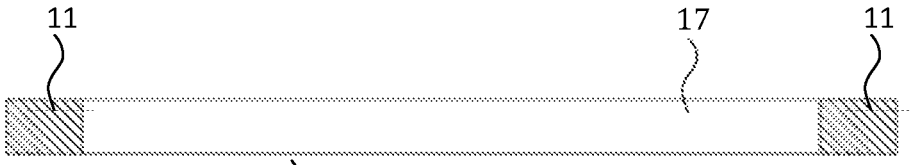
FIGS. 7A-7C show embodiments of the invention having alternative arrangements of the reversibly adherent fastener surfaces on the sandal straps.

Referring now to FIG. 7A, a top view (the "first side") of one embodiment of strap 1 is shown, wherein a first section is located at or near the first end. The surface 11 of this first section features the hook component of a hook-and-loop system, and this section will typically be made from a non-stretch fabric. A second, center section features a surface 17 which is the loop component of a hook-and-loop system. A third section is located at the other end, and like the first section, the surface 11 features the hook component of a hook-and-loop system.

Figure 7B:
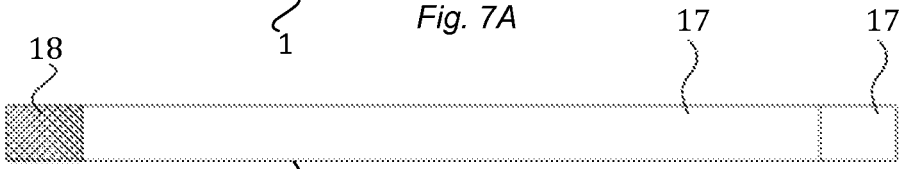
Figure 7C:
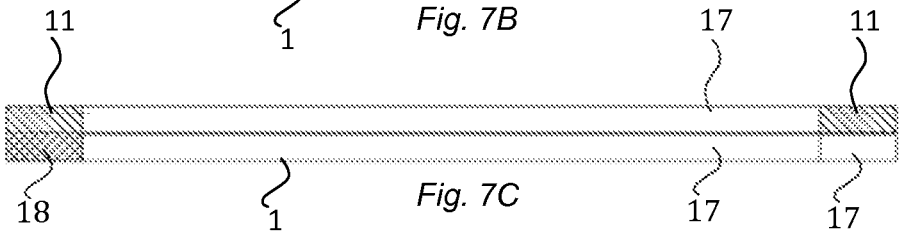

FIG. 7B shows the reverse side (the "second side") of strap 1. The first section, on this side, features a surface 18 that may be either the loop component of a hook-and-loop system, or optionally a non-adherent fabric surface. A second, section features a surface 17 which is the loop component of a hook-and-loop system; this section extends to the end of the strap. In this embodiment, the hook components 11 on the first side are normally engaged with the loop portion 17 on the first side of the strap, or else with a loop portion of another strap.

Figure 1A:
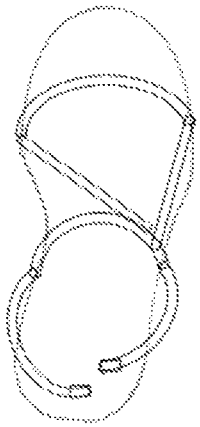
FIGS. 1A-1L show some of the strap configurations that are made possible by the sandals of the present invention.
Figure 1B:
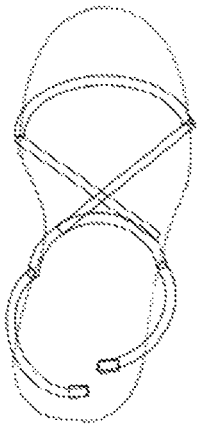
Figure 1C:
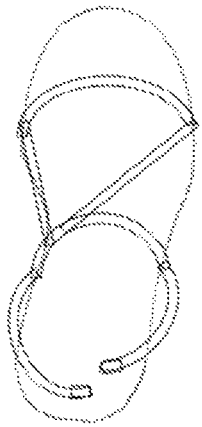
Figure 1D:
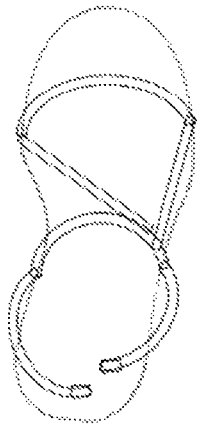
Figure 1E:
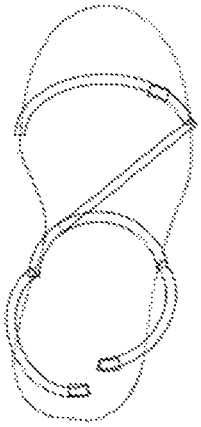
Figure 1F:
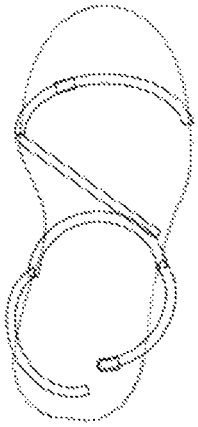
Figure 1G:
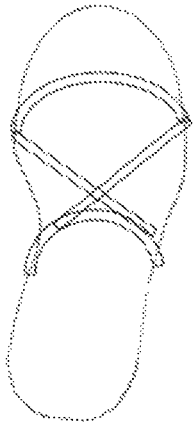
Figure 1H:
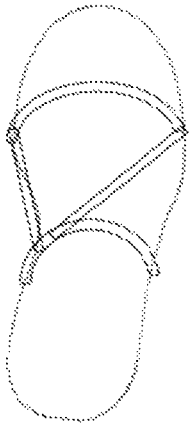
Figure 1I:
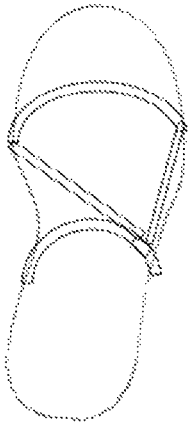
Figure 1J:
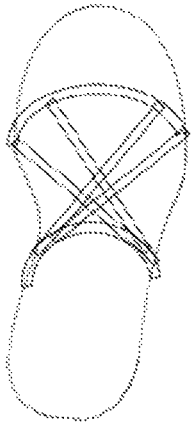
Figure 1K:
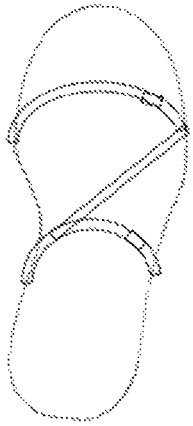
Figure 1L:
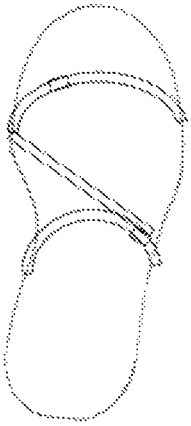

FIG. 1C shows a side view, not to scale, of the strap 1, with the various surfaces shown in relation to one another.

In alternative embodiments of this and all other straps illustrated or described herein, the hook and loop surfaces will be interchanged; it will be appreciated that these "switched" embodiments function in exactly the same way. In all embodiments, individual loop sections, when back-to-back or backed by plain fabric, may optionally be made from a stretchable loop fabric. Such elastic sections will typically be formed from a woven polyurethane blend, preferably capable of being stretched by a factor of at least 1.1 (10% elongation), more preferably by a factor of at least 1.2 (20% elongation).

Figure 8A:
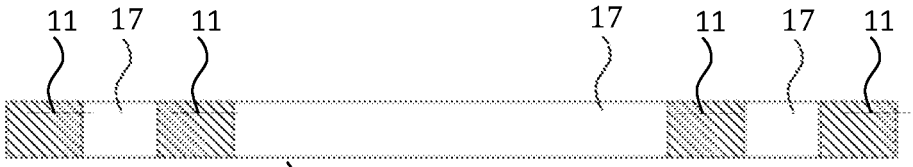
FIGS. 8A-8C show embodiments of the invention having alternative arrangements of the reversibly adherent fastener surfaces on the sandal straps.

Referring now to FIG. 8A, a top view (the "first side") of an embodiment of strap 1 is shown, wherein a first section is located at or near the first end. The surface 11 of this first section features the hook component of a hook-and-loop system, and this section will typically be made from a non-stretch fabric. A second section features a surface 17 which is the loop component of a hook-and-loop system. A third section is located adjacent to the second section, and like the first section, the surface 11 features the hook component of a hook-and-loop system. Adjacent to the third section is a longer, central fourth section, which in the embodiment shown features, on this surface, the loop component 17 of a hook-and-loop fastener system. Adjacent to the fourth section is a fifth section, which, in the embodiment shown, features on its surface the hook component 11 of a hook-and-loop fastener system. Adjacent to the fifth section is a sixth section which, like second and fourth sections, features loop component 11. Adjacent to the sixth section is a final, seventh section, featuring, in this embodiment, the hook component 11 of a hook-and-loop fastener system on its first surface.

Figure 8B:
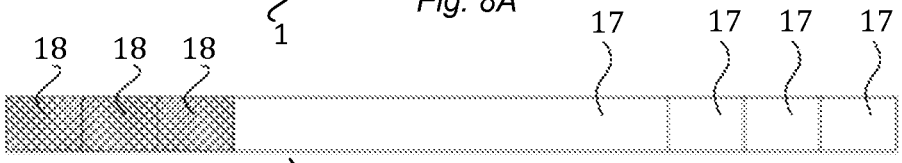

FIG. 8B shows the reverse side ("second side") of this embodiment of the strap 1. The first, second, and third sections, on this surface, feature a surface 18 that may be either the loop component of a hook-and-loop system, or optionally a non-adherent fabric surface. A fourth section features a surface 17 which is the loop component of a hook-and-loop system; this section extends to the end of the strap.

Figure 8C:
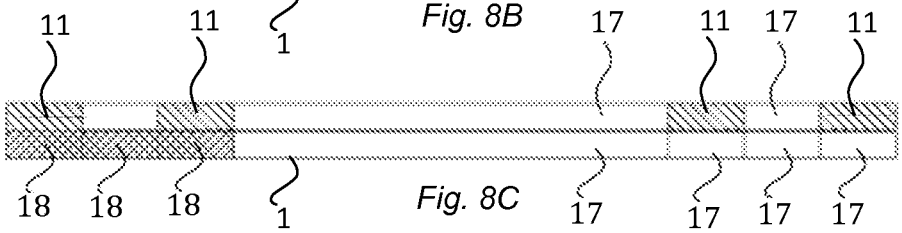
Figure 9A:
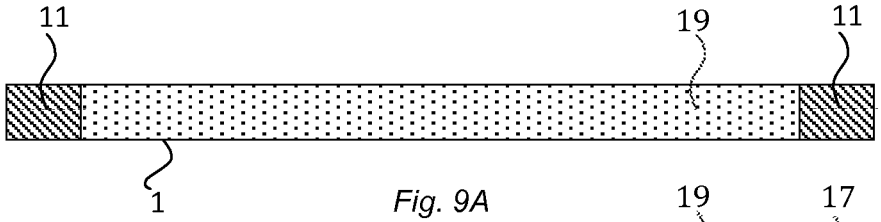
FIGS. 9A-9C show embodiments of the invention having alternative arrangements of the reversibly adherent fastener surfaces on the sandal straps.
Figure 9B:
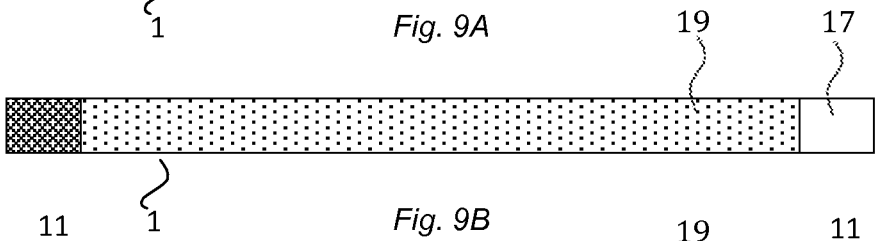
Figure 9C:
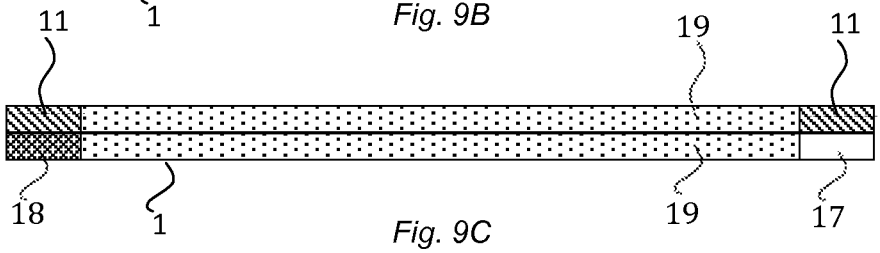
Figure 10A:
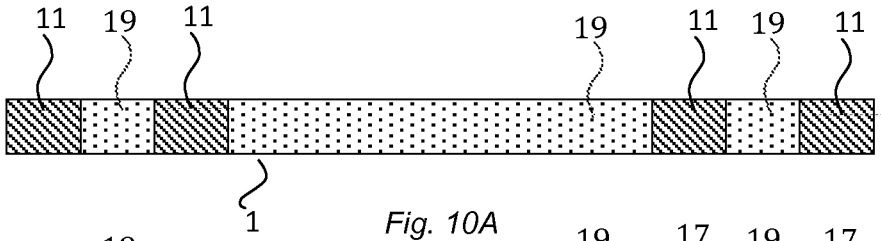
FIGS. 10A-10C show embodiments of the invention having alternative arrangements of the reversibly adherent fastener surfaces on the sandal straps.
Figure 10B:
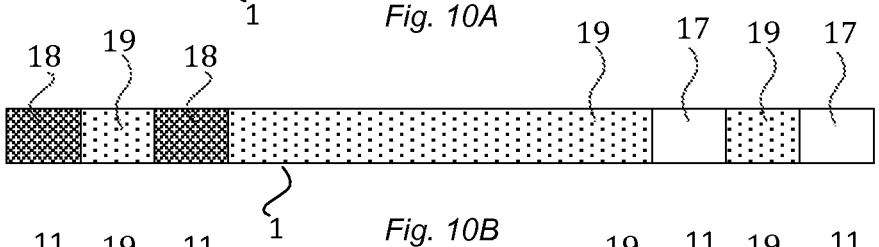
Figure 10C:
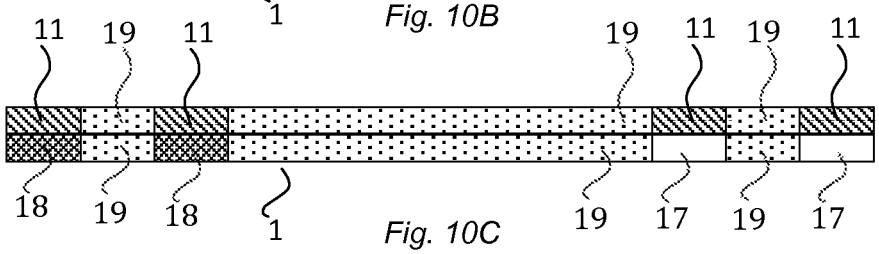
Figure 11A:
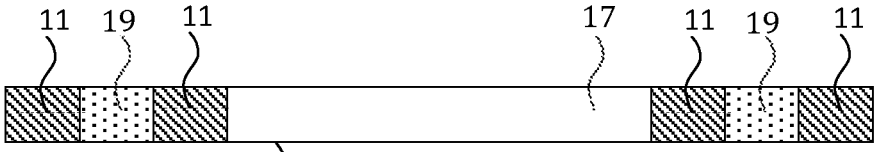
FIGS. 11A-11C show embodiments of the invention having alternative arrangements of the reversibly adherent fastener surfaces on the sandal straps.
Figure 11B:
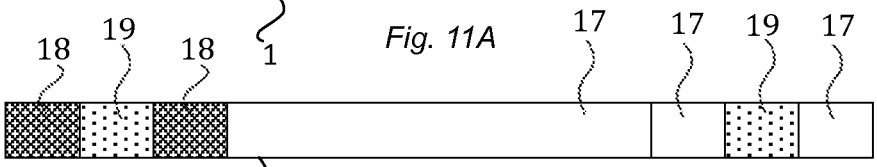
Figure 11C:
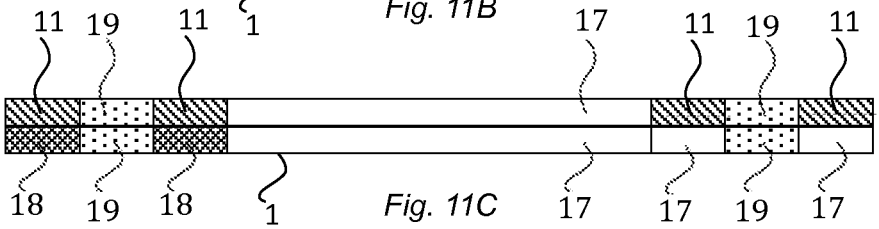
Figure 12A:
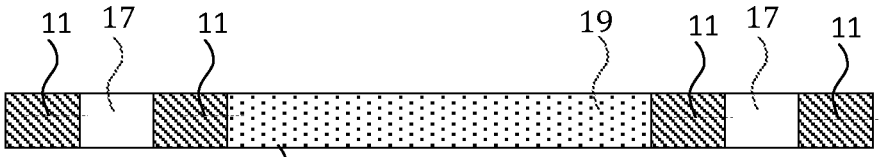
FIGS. 12A-12C show embodiments of the invention having alternative arrangements of the reversibly adherent fastener surfaces on the sandal straps.
Figure 12B:
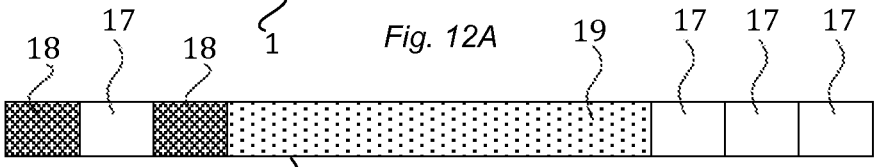
Figure 12C:
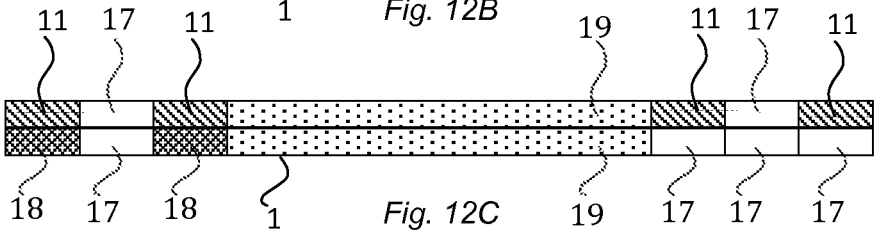

FIG. 8C shows a side view, not to scale, of this embodiment of the strap 1, with the various surfaces shown in relation to one another.

FIG. 2 is a perspective view of one embodiment of a sandal according to the present invention, having two straps 1 configured as shown in FIGS. 8A-8C. The sandal body in this embodiment consists of a footbed 9 adhered to a sole 10. Strap 1 is arranged so as to pass over the foot of the wearer and through anchoring loops 16 on either side of the foot, and the strap is pulled snug. The ends of strap 1 are then brought back up over the foot. The second end of the strap is brought down so that the hook surfaces on the first side (not shown) of the fifth and seventh sections contact and adhere to complimentary loop surface in the central region of the first side, designated 13 in FIG. 2. This leaves the loop surfaces on the second side of the fifth, sixth and seventh sections (6, 7, and 8, respectively) exposed on the upper surface of the strap. The second end is then brought down so that the hook surfaces on the first section (not shown) and on the third section (12) contact and adhere to the exposed loop surfaces, leaving exposed the second side of the first section (2), second section (3), third section (not shown), and fourth, central section (5).

When re-configured to attach to the arms or legs, the same steps are employed, with the hook surfaces engaging with the central loop surface 13.

FIGS. 9-12 illustrate some alternative embodiments of the arrangements of the hook and loop (or equivalent) fastener elements. In all drawings, the relative dimensions of the elements are not to scale, the relative sizes illustrated have been selected merely to give clarity to the drawings. In all of these figures, hook elements are indicated as 11. Elements 17 are substantially non-stretching loop components, while elements 18 are non-stretch material that may present a non-adherent surface, or optionally may also be a loop component. Elements 19 are loop components that are stretch material. As noted above, the stretch material preferably offers at least 10% elongation, and more preferably at least 50% elongation.

In using all of the embodiments shown in FIGS. 7-12, the same approach is employed: When wrapped around the feet, certain mating hook and loop components will face one another; while when wrapped around the arms or legs, different pairs of mating components will line up, so as to accommodate the larger circumference of the limbs.

Figure 13:
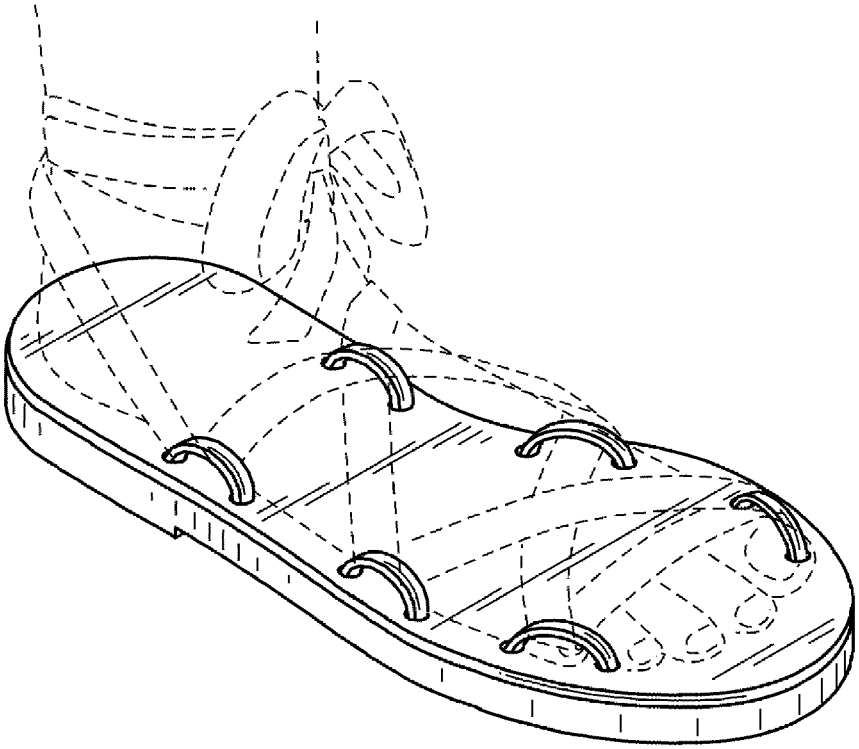
(Prior Art) Fig. 13
FIG. 13 shows a prior art sandal having six anchoring loops.
Figure 14:
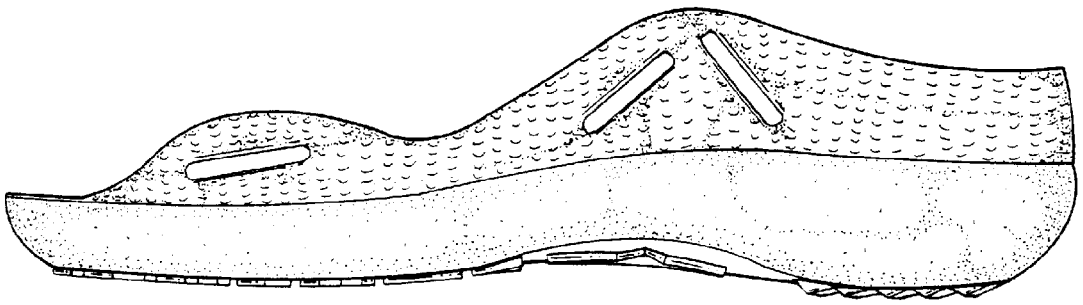
(Prior Art) Fig. 14
FIG. 14 shows a prior art sandal having a separate sidewall.

The scope of the invention is not limited to the arrangement of straps shown in FIG. 2. It will be readily appreciated that there are alternative methods of arranging the straps on the sandals of the present invention, some of which are shown in FIGS. 1A-1L. For example, straps may be passed diagonally across the top of the foot, and may be run around the ankle and/or rear of the foot above the heel. An additional anchoring loop may optionally be located between the big toe and the second toe, and a third pair of anchoring loops may optionally be provided along the sides of the sandal as shown in FIG. 13 (see U.S. Pat. No. D644,823.) One or more of the anchoring loops can, if desired, be formed in a separate sidewall component, as shown for example in FIG. 14 (see U.S. Pat. No. 5,423,134 and U.S. Pat. No. D402,445.) It is a particular advantage of the present invention that a single set of straps gives the wearer the ability to select from among most, or even all, of the illustrated configurations, either for style or to optimize comfort.

The drawings appended to this description are provided for illustrative purposes only, and present only selected embodiments of the invention. Those skilled in the art will readily envision substitutions and modifications of the embodiments illustrated and disclosed; such obvious variants are intended to be within the scope of the present invention.

I claim:

1. A sandal having at least two straps configured to hold the sandal to a person's foot, each strap having a first side and a second side, and a first end and a second end, and having a plurality of sequentially arranged sections on both sides, wherein (a) at least two sections, disposed on the second side, comprise a first component of a reversibly adherent fastener system;

(b) at least one section, disposed on the second side, comprises a complimentary, second component of the reversibly adherent fastener system; and (c) at least one section, disposed on the first side, comprises the complimentary second component of the reversibly adherent fastener system.

2. A sandal according to claim 1, having at least seven sequentially arranged sections, wherein (a) a first section is located at or near the first end, and comprises a hook surface of a hook-and-loop fastener system disposed on the second side;

(b) an elastic second section is located adjacent to the first section;

(c) a third section is located adjacent to the second section, and comprises a hook surface of a hook-and-loop fastener system disposed on the second side;

(d) a fourth section is located adjacent to the third section, and comprises a loop surface of a hook-and-loop fastener system, disposed on both the first and second sides;

(e) a fifth section is located adjacent to the fourth section, and comprises a hook surface of a hook-and-loop fastener system disposed on the second side and a loop surface disposed on the first side;

(f) an elastic sixth section is located adjacent to the fifth section; and (g) a seventh section is located adjacent to the sixth section, and comprises a hook surface of a hook-and-loop fastener system disposed on the second side and a loop surface disposed on the first side.

3. A sandal according to claim 1, having at least seven sequentially arranged sections, wherein (a) a first section is located at or near the first end, and comprises a loop surface of a hook-and-loop fastener system disposed on the second side;

(b) an elastic second section is located adjacent to the first section;

(c) a third section is located adjacent to the second section, and comprises a loop surface of a hook-and-loop fastener system disposed on the second side;

(d) a fourth section is located adjacent to the third section, and comprises a hook surface of a hook-and-loop fastener system, disposed on both the first and second sides;

(e) a fifth section is located adjacent to the fourth section, and comprises a loop surface of a hook-and-loop fastener system disposed on the second side and a hook surface disposed on the first side;

(f) an elastic sixth section is located adjacent to the fifth section; and (g) a seventh section is located adjacent to the sixth section, and comprises a loop surface of a hook-and-loop fastener system disposed on the second side and a hook surface disposed on the first side.

4. A sandal according to claim 1, having at least seven sequentially arranged sections, wherein (a) a first section is located at or near the first end, and comprises a surface of a mushroom fastener system disposed on the second side;

(b) an elastic second section is located adjacent to the first section;

(c) a third section is located adjacent to the second section, and comprises a surface of a mushroom fastener system disposed on the second side;

(d) a fourth section is located adjacent to the third section, and comprises a surface of a mushroom fastener system, disposed on both the first and second sides;

(e) a fifth section is located adjacent to the fourth section, and comprises a surface of a mushroom fastener system disposed on the first and second sides;

(f) an elastic sixth section is located adjacent to the fifth section; and (g) a seventh section is located adjacent to the sixth section, and comprises a surface of a mushroom fastener system disposed on the first and second sides.

5. The sandal according to claim 1, wherein the sandal body has a effective density of less than 0.6 g/cm$^3$.

6. The sandal according to claim 2, wherein the sandal body has a effective density of less than 0.6 g/cm$^3$.

7. The sandal according to claim 3 wherein the sandal body has a effective density of less than 0.6 g/cm$^3$.

8. The sandal according to claim 4 wherein the sandal body has a effective density of less than 0.6 g/cm$^3$.

9. The sandal according to claim 1, wherein the sandal body has a effective density of less than 0.4 g/cm$^3$.

10. The sandal according to claim 2, wherein the sandal body has a effective density of less than 0.4 g/cm$^3$.

11. The sandal according to claim 3, wherein the sandal body has a effective density of less than 0.4 g/cm$^3$.

12. The sandal according to claim 4 wherein the sandal body has a effective density of less than 0.4 g/cm$^3$.

13. The sandal according to claim 1, wherein the sandal body has a effective density of less than 0.2 g/cm$^3$.

14. The sandal according to claim 2, wherein the sandal body has a effective density of less than 0.2 g/cm$^3$.

15. The sandal according to claim 3, wherein the sandal body has a effective density of less than 0.2 g/cm$^3$.

16. The sandal according to claim 4, wherein the sandal body has a effective density of less than 0.2 g/cm$^3$.

* * * * *